US006845525B2

(12) United States Patent
Bathurst

(10) Patent No.: US 6,845,525 B2
(45) Date of Patent: Jan. 25, 2005

(54) SHOWER EXPANDER

(76) Inventor: David B. Bathurst, 19857 Susan Ct., Clinton Township, MI (US) 48035

( * ) Notice: Subject to any disclaimer, the term of this patent is extended or adjusted under 35 U.S.C. 154(b) by 0 days.

(21) Appl. No.: 10/659,137

(22) Filed: Sep. 10, 2003

(65) Prior Publication Data

US 2004/0128754 A1 Jul. 8, 2004

Related U.S. Application Data

(60) Provisional application No. 60/410,210, filed on Sep. 12, 2002.

(51) Int. Cl.[7] ..... A47K 3/22; A47K 3/34; A47K 3/36

(52) U.S. Cl. ..... 4/608; 4/558

(58) Field of Search ..... 4/557, 558, 607, 4/608

(56) References Cited

U.S. PATENT DOCUMENTS

| | | | | |
|---|---|---|---|---|
| 699,786 | A | 5/1902 | Campbell | |
| 2,185,305 | A | 1/1940 | Marchand | 160/126 |
| 2,188,163 | A | 1/1940 | Sherman | 160/327 |
| 2,212,326 | A | 8/1940 | Piker | 4/558 |
| 2,232,194 | A | 2/1941 | Zogby | 160/349.1 |
| 2,239,630 | A | 4/1941 | Tendrian et al. | 160/330 |
| 2,303,502 | A | 12/1942 | Rous | 24/334 |
| 2,313,421 | A | 3/1943 | Dalton, Jr. | 4/558 |
| 2,454,434 | A | 11/1948 | Cunningham | 160/40 |
| 2,500,350 | A | 3/1950 | Endres | 4/148 |
| 2,573,985 | A | 11/1951 | Porter | |
| 2,608,250 | A | 8/1952 | Meyer | 160/349.2 |
| 2,613,368 | A | 10/1952 | Rosenbaum | 4/608 |
| 2,668,298 | A | 2/1954 | Kimmons | 4/608 |
| 2,751,150 | A | 6/1956 | Buccicone | 235/98 A |
| 2,771,945 | A | 11/1956 | Wittrup | 160/124 |
| 2,774,974 | A | 12/1956 | Zaloga | |
| 2,840,160 | A | 6/1958 | Tichenor | 160/349.1 |
| 2,862,211 | A | 12/1958 | Shabarman et al. | |
| 2,878,487 | A | 3/1959 | Foote | |
| 3,104,014 | A | 9/1963 | Piette | |
| 3,418,665 | A | 12/1968 | Long | |
| 3,872,520 | A | 3/1975 | Tyconik | 4/154 |
| 4,070,735 | A | 1/1978 | Canaday | 24/304 |
| 4,771,517 | A | 9/1988 | Bonanno | |
| 4,825,481 | A | 5/1989 | Lonberger | 4/608 |
| 5,023,964 | A | 6/1991 | Unsworth | 4/558 |
| 5,033,132 | A | 7/1991 | Greenblatt | 4/608 |
| 5,083,330 | A | 1/1992 | Dusar | |
| 5,216,766 | A | 6/1993 | Lang | |
| 5,339,884 | A | 8/1994 | Angerman | 160/330 |
| 5,345,623 | A | 9/1994 | Dearman | 4/608 |
| 5,345,624 | A | 9/1994 | Brown, III | 4/610 |
| 5,345,992 | A | 9/1994 | Turner | 160/330 |
| 5,351,739 | A | 10/1994 | Levy | 160/124 |
| 5,402,842 | A | 4/1995 | Ruggiero | |
| 5,421,393 | A | 6/1995 | Wolfe | 160/349.1 |
| 5,447,244 | A | 9/1995 | Mentzer | 211/123 |
| 5,495,628 | A | 3/1996 | Logan | |
| 5,543,196 | A | 8/1996 | Robinson et al. | |
| 5,651,407 | A | 7/1997 | Perez | 160/330 |
| 5,673,962 | A | 10/1997 | Maieli et al. | 296/164 |
| 5,771,504 | A | 6/1998 | Steiner | 4/558 |
| 5,787,954 | A | 8/1998 | Herrera | |
| 5,809,589 | A | 9/1998 | Johnson | 4/609 |
| 5,901,769 | A | 5/1999 | Farley | |
| 5,947,603 | A | 9/1999 | Tilman | 383/64 |

(List continued on next page.)

*Primary Examiner*—Tuan Nguyen
(74) *Attorney, Agent, or Firm*—Young & Basile, P.C.

(57) ABSTRACT

A shower expander assembly for a shower stall having an access opening includes a flexible plate on a shower curtain. The flexible plate has a flexible line connected to a center portion of the plate. At the opposing end of the flexible line is a ring or loop for hooking over a hook secured to an opposing wall outside of the shower stall. When the ring or loop is pulled away from the access opening and connected to the hook, the shower curtain bows outwardly to increase the usable space in the shower stall.

14 Claims, 2 Drawing Sheets

U.S. PATENT DOCUMENTS 5,950,255 A 9/1999 Thompson ..... 4/557
5,974,603 A 11/1999 Frazier ..... 4/558
6,032,306 A 3/2000 Gummin ..... 4/610
6,038,749 A 3/2000 Eberhardt
6,041,454 A 3/2000 Summerford ..... 4/558
6,049,920 A 4/2000 Mochizuki
6,098,699 A 8/2000 Junius
6,163,899 A 12/2000 Leonard
6,192,965 B1 2/2001 Hinds ..... 160/330
6,289,967 B1 9/2001 Moore ..... 160/330
6,394,168 B1 5/2002 Zoboski
6,488,070 B1 12/2002 Cox ..... 160/84.01
6,565,144 B1 5/2003 Crean ..... 296/168

SHOWER EXPANDER

This application claims priority of Provisional Patent Application Ser. No. 60/410,210 filed on Sep. 12, 2002.

FIELD OF THE INVENTION

The present invention relates to shower compartments, and in particular relates to an assembly to expand the shower curtain so as to increase the effective interior area of the shower compartment.

BACKGROUND OF THE INVENTION

Recreational vehicles are a popular means of transport for people who wish to travel to remote areas, and who wish to enjoy the comforts of home, but do not want the expense of numerous hotel bills. In response, the recreational vehicle industry has provided vehicles that provide substantially increased living area within the confines of current regulations. Although some newer models have increased living, eating, bedroom, and bathroom areas to accommodate a larger number of people as well as a more spacious feel to the recreational vehicle, there are many older models still in use, as well as some newer models, that have a small shower stall area.

The typical shower stall includes a small, rectangular platform surrounded by three walls. The fourth wall is an access opening covered by a flexible, water-resistant shower curtain which suspends from a curtain rod. The shower curtain spans the width of the opening. An adult using the shower stall will generally find that the confines of the shower stall to be a deterrent for his enjoyment of the recreational vehicle in general.

It is in the intent of the invention to address the disadvantage of a recreational vehicle and particularly the disadvantage of small shower stalls.

SUMMARY OF THE INVENTION

The present invention provides a shower expander assembly that can be either retrofitted to an existing shower curtain or provided as an assembly in combination with a shower curtain that deflects the shower curtain outwardly with a pulling force through the opening of the shower stall and maintains the shower curtain in that position during the use of the shower so that an increase of usable space within the shower stall is provided for the user.

In one aspect of the invention, the shower expander assembly includes an expander plate connectible to a shower curtain, a flexible line having one end attached to a planar surface of the plate at one end and a looping means attached to the opposing end of the flexible line. The looping means provides a means for connecting the shower expander assembly to a stationary connector on an opposing wall from the shower curtain.

In another aspect of the invention, the looping means can be a ring tied to an end of the flexible line or a loop formed by the end of the flexible line.

In yet another aspect of the invention, the expander plate may be either removably attached or permanently attached to the shower curtain.

The present invention may also include a sleeve securely attached to the shower curtain, having at least one open end for receiving the plate therein. Further, the sleeve may have a through aperture for receiving the flexible line therethrough.

In yet another aspect of the invention, the shower expander assembly may further include a base plate having at least one projection expanding from one planar surface of the base plate and the expander plate having at least one aperture positioned for receiving the one projection of the base plate through a hole in the shower curtain for connecting the expander plate to the base plate with a portion of the shower curtain between.

In yet another aspect of the invention, the at least one projection has means for securing one end of the flexible line thereon.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figure 1:
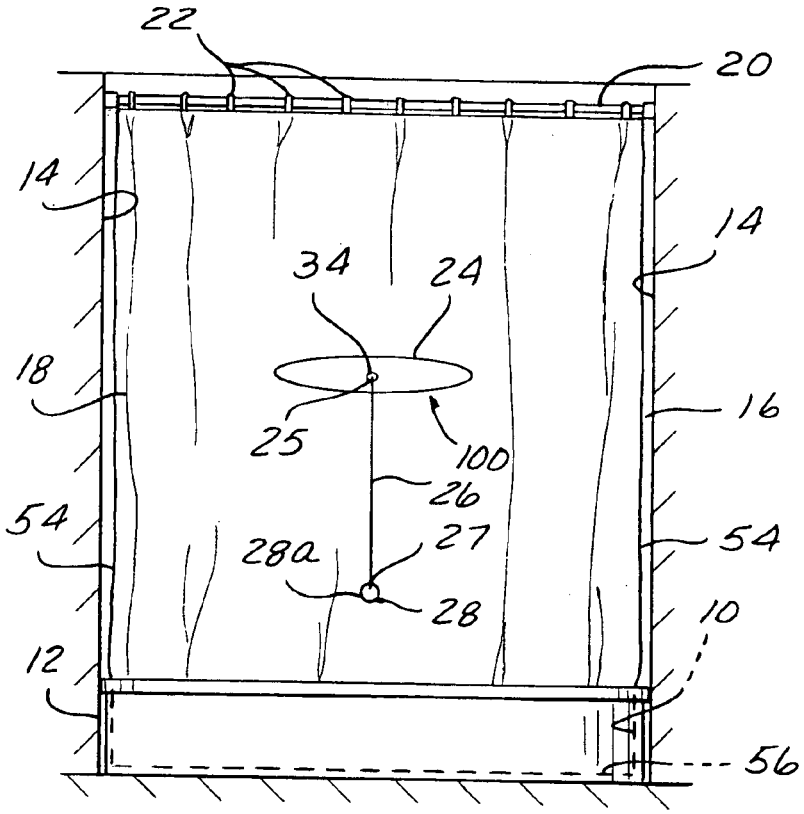
FIG. 1 is an elevational view of a shower stall with a shower curtain having the shower expander assembly according to the present invention.

A typical shower stall 10 includes a tub or base pan 12 having walls 14 surrounding the pan 12 on three sides and an access opening 16 selectively closed by a shower curtain 18. The shower curtain 18 is held in place by a rod 20 in which shower rings 22 connected to the shower curtain 18 can slide along the length of the rod 20 to selectively open and close the access opening 16.

The shower expander assembly 100 of the present invention includes an expander plate 24, a flexible line 26 connected at one end to a center portion of the expander plate 24. On the opposing end of the flexible line 26 there is a looping means 28 for connection to a hook, knob, or peg 30 securely attached to an opposing wall 32 from the access opening 16.

Figure 2:
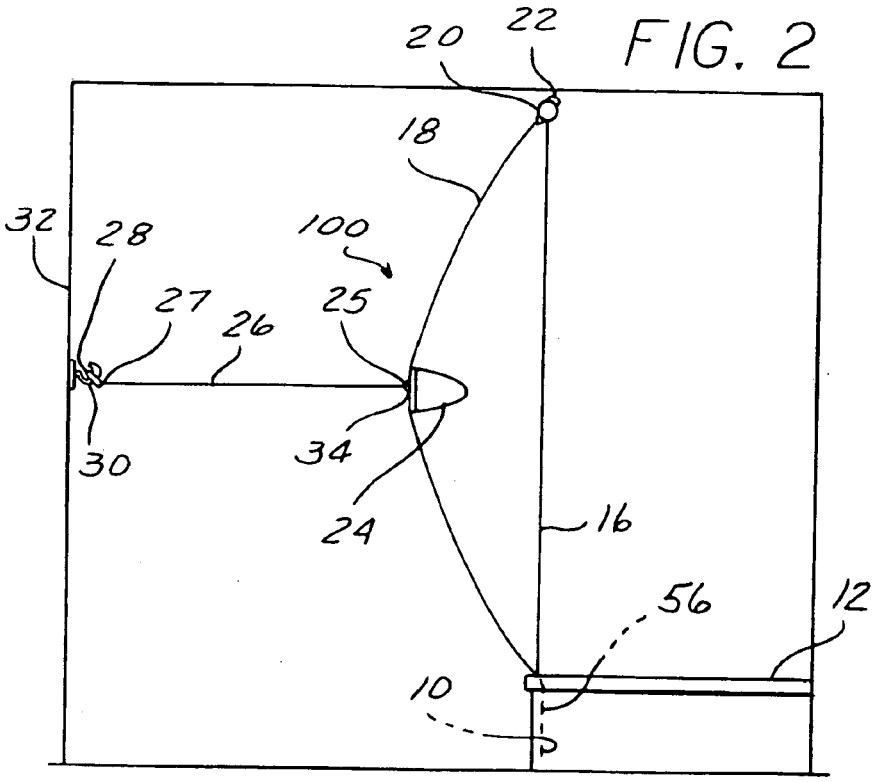
FIG. 2 is a schematic side view of the shower stall and shower curtain with the shower expander assembly in the operable position.

The expander plate 24 is preferably made from a lightweight semi-flexible plastic material. Although other planar geometric configurations may be used, the expander plate 24 has preferably an oval or rectangular shape as shown in FIGS. 1, 3, 4, and 6. The oval or rectangular expander plate is preferably placed or connected to the shower curtain in a horizontal manner, as shown in the figures. It is preferable that the horizontal length of the expander plate is approximately eighteen inches. When the shower expander assembly 100 is in the operable position, as shown in FIG. 2, the oval or rectangular shape placed in a horizontal manner provides the maximum amount of increased area within the shower stall. The expander plate 24 may be attached to the shower curtain 18 by means of an adhesive, Velcro®, or other means as disclosed hereinafter. The expander plate 24 is preferably positioned in the center of the shower curtain 18 to provide maximum increase in area and to accommodate the general location of an adult's arms and torso. In one embodiment, the expander plate 24 may have a loop 34 formed in the center of the plate from the same plastic as the expander plate 24 for connecting one end 25 of the flexible line 26 thereto.

Figure 5:
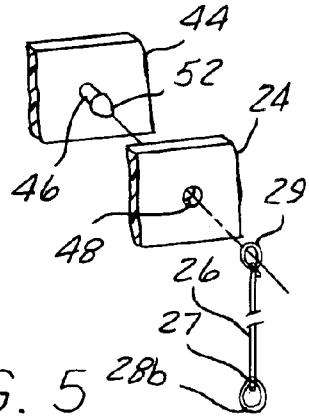
FIG. 5 shows an enlarged portion of the shower expander assembly of FIG. 4.

The flexible line 26 is securely attached to the expander plate 24. The flexible line 26 can be any sturdy string. However, for aesthetic reasons, it is preferred that the flexible line 26 is clear, such as fishing line, so that the flexible line 26 is not noticeable and does not detract from the shower curtain 18. In the assembly, the flexible line 26 can be provided with varying lengths and cut by the user to accommodate the particular environment and distance to the opposing wall 36 or other stationary object. After the flexible line 26 has been measured and cut to the desired length for connection to hook 30, a looping means 28 may be connected to or configured from the free end 27 of the flexible line 26. FIG. 1 shows the looping means 28 to be a ring 28*a* tied to the free end 27 of the flexible line 26. FIG. 5 shows the looping means to be a loop 28*b* formed and tied into a loop configuration by the free end 27 of the flexible line 26. The looping means 28 can also encompass other attachment means such as clips, hooks, Velcro®, etc.

Figure 3:
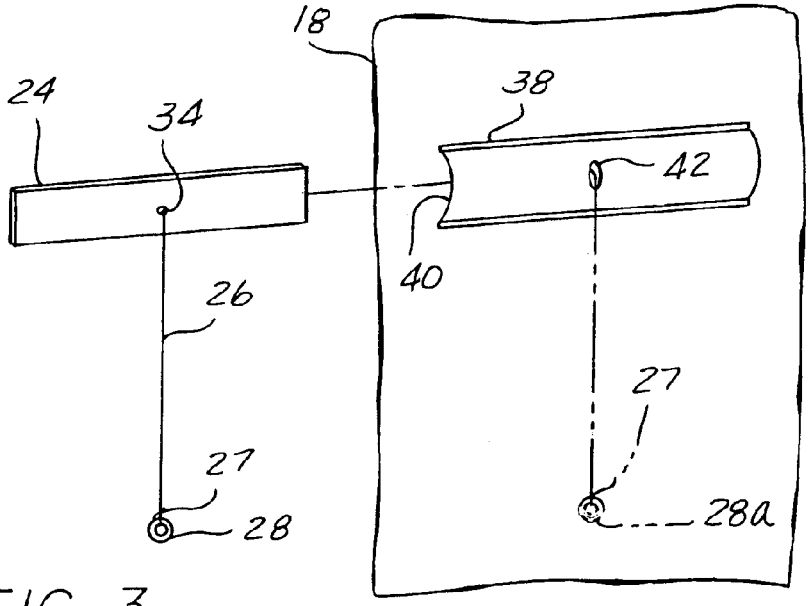
FIG. 3 shows a perspective view of a second embodiment of the shower expander assembly on a shower curtain.

FIG. 3 shows another embodiment of the shower expander assembly 100. A sleeve 38 is secured to the shower curtain 18. The sleeve 38 may be secured by adhesive, Velcro®, or other conventional means. The sleeve 38 will have at least one open end 40 and a configuration for receiving a similar sized expander plate 24. The sleeve 38 may have a through aperture 42 for either threading the flexible line 26 therethrough after the expander plate 24 has been positioned within the sleeve. Or as an alternative, the one end 25 of the flexible line 26 can be attached to the loop 34 after the expander plate 24 is positioned within the sleeve 38. Although not shown, the sleeve 38 may instead include the formed loop 34 thereon for receiving the one end of the flexible line 26.

Figure 4:
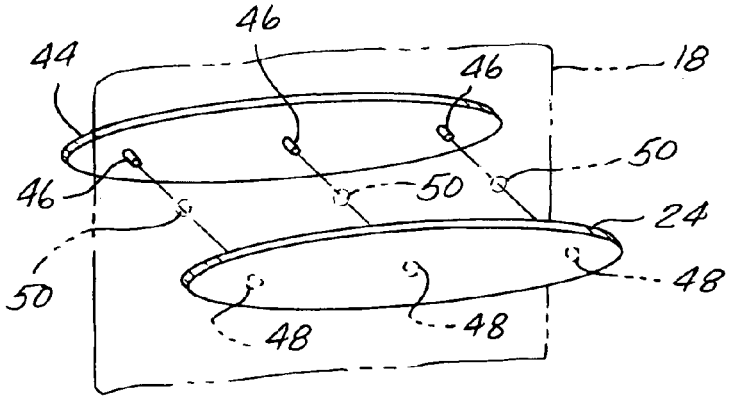
FIG. 4 shows a perspective view of a third embodiment of the shower expander assembly.

FIG. 4 shows another alternative embodiment for attaching the expander plate to the shower curtain 18. In FIG. 4, the shower expander assembly 100 has an expander plate 24 as well as a base plate 44. Either the base plate 44 or the expander plate 24 has projections 46 extending from one planar side of the plate 24 or 44. The other plate 24 or 44 will have corresponding apertures 48 for receiving the projections 46 of the other plate. In FIG. 4, it is shown that the base plate 44 includes the projections 46 while the expander plate 24 has the corresponding apertures 48. However, the projections 46 and the apertures 48 can be interchanged so that the expander plate 24 has the projections 46 while the base plate 44 has the corresponding apertures 48. The base plate 44 and expander plate 24 are connected to the shower curtain 18 by pushing the projections 46 through holes 50 created by the projections 46 or preformed into the shower curtain 18. The expander plate 24 and base plate 44 are then placed adjacent to each other with the shower curtain 18 sandwiched therebetween, so that the projections 46 are disposed within the corresponding apertures 48. As shown in FIG. 5, one or all of the projections 46 may include a flanged end 52 for securing the projection 46 to the other side of the aperture 48 of the expander plate 24. Also, as can be seen in FIG. 5, the flanged end 52 of the projection may be used instead of the loop 34 for securing one end of the flexible line 26. The first end 25 of the flexible line 26 may have another ring 29 connected thereon for hanging around the flanged end 52, or the first end 25 may simply be tied around the projection 46.

Figure 6:
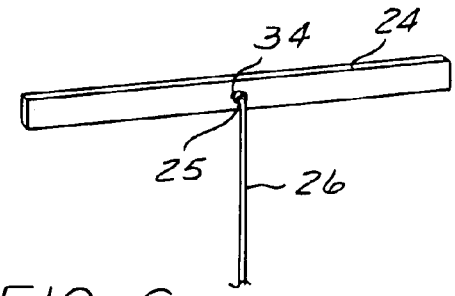
FIG. 6 shows a perspective view of another configuration of the expander plate for the shower expander assembly of the present invention.

FIG. 6 shows another configuration of the expander plate 24 to indicate that other configurations and shapes for the expander plate 24 are foreseeable. However, the oval shape and the rectangular shape having a vertical length of at least two inches provide at least a 50% increase to the shower area.

As stated, supra, the shower expander assembly 100 further includes a hook 30 securely connected to a stationary object 36 across from the access opening 16. The stationary object 32 is usually a wall or cupboard. In the alternative, the hook 30 may be replaced with a knob, peg, clip, Velcro®, or other similar object secured into the stationary object 36 for receiving and releasably securing the free end 27 of the flexible line 26.

To place the shower expander assembly 100 in its operable position, the user attaches the looping means 28 onto the hook 30. The hook 30, as stated supra, is fixedly attached to an opposing wall 32 or other stationary object. As the flexible line 26 is pulled toward the hook 30, the shower curtain 18 will bow out in a center portion of the shower curtain 18 from the inside tub edge. When in use, the shower expander assembly 100 will increase the inside shower area by fifty percent or more. At the same time as the center portion of the shower curtain is being bowed out, the outward pressure of the shower curtain edges seal the two ends 54 and bottom 56 of the shower curtain 18 to the inside front periphery of the tub base, thus minimizing water leaks.

The shower expander assembly 100 of the present invention creates a space which is portably usable and expandable and adaptable to fit various size bathroom and showers. The shower expander assembly of the present invention can be retrofitted to existing shower curtains or be provided as an assembly including the shower curtain. When the assembly includes a shower curtain 18, the expander plate 24 may be sealed directly into or onto the shower curtain 18.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law. In particular, although the shower expander assembly is described with reference to a shower stall in a recreational vehicle, it is to be understood that the shower expander of the present invention can be used in the home as well as other environments. As another modification, clips, hooks, or Velcro® can also be used for connecting the flexible line 26 to the expander plate 24 which would have corresponding attachment means.

What is claimed is:

1. A shower expander assembly for a shower stall having an access opening comprising:

an expander plate connectible to a shower curtain;

a flexible line attached to a planar surface of the plate at one end; and a looping means attached to the opposing end of the flexible line.

2. The shower expander assembly of claim 1 further comprising a hook for attaching on a stationary object located opposite the access opening of the shower stall, said hook positionable for securing the looping means when the shower expander assembly is in an operable position.

3. The shower expander assembly of claim 1, wherein the plate has one of an oval and rectangular configuration.

4. The shower expander assembly of claim 1, further comprising means for removably attaching the plate to the shower curtain.

5. The shower expander assembly of claim 1, further comprising means for permanently attaching the plate to the shower curtain.

6. The shower expander assembly of claim 1, wherein the looping means includes a ring.

7. The shower expander assembly of claim 1, wherein the looping means includes a loop formed by the flexible line.

8. The shower expander assembly of claim 1, further comprising a sleeve securely attached to the shower curtain and having at least one open end for receiving the plate therein.

9. The shower expander assembly of claim 8, wherein the sleeve has a through aperture therein for receiving the flexible line therethrough.

10. The shower expander assembly of claim 1 further comprising a base plate having at least one projection extending from one planar surface and the expander plate having at least one aperture positioned for receiving the one projection of the base plate through a hole in the shower curtain for connecting the expander plate and base plate with a portion of the shower curtain therebetween.

11. The shower expander assembly of claim 10, wherein the at least one projection has means for securing one end of the flexible line thereon.

12. The shower expander assembly of claim 1, wherein the expander plate is sealed into or onto the shower curtain.

13. A shower expander assembly for a shower stall having an access opening comprising:

a shower curtain located in the access opening;

a flexible line communicating with the shower curtain for applying a pulling force thereto, for moving a portion of the shower curtain through the access opening and away from the shower stall to form an expanded area in the shower stall; and means for selectively maintaining the expanded area in the shower stall.

14. The shower expander assembly of claim 13 wherein the means for selectively maintaining the expanded area in the shower stall includes a first attachment means on a free end of the flexible line and a corresponding second attachment means secured to a stationary item positioned across from the access opening, wherein the first attachment means is selectively connectible to the corresponding second attachment means.

* * * * *